US010115507B2

(12) United States Patent
Nagata et al.

(10) Patent No.: US 10,115,507 B2
(45) **Date of Patent: *Oct. 30, 2018**

(54) LOW-B BARE EARTH MAGNET

(71) Applicant: Xiamen Tungsten Co., Ltd., Fujian (CN)

(72) Inventors: Hiroshi Nagata, Fujian (CN); Rong Yu, Fujian (CN)

(73) Assignee: Xiamen Tungsten Co., Ltd., Fujian (CN)

( * ) Notice: Subject to any disclaimer, the term of this patent is extended or adjusted under 35 U.S.C. 154(b) by 180 days.

This patent is subject to a terminal disclaimer.

(21) Appl. No.: 15/165,290

(22) Filed: May 26, 2016

(65) Prior Publication Data

US 2016/0268025 A1 Sep. 15, 2016

Related U.S. Application Data

(63) Continuation of application No. PCT/CN2014/092225, filed on Nov. 26, 2014.

(30) Foreign Application Priority Data

Nov. 27, 2013 (CN) ..... 2013 1 0639023

(51) Int. Cl.
*H01F 1/057* (2006.01)
*C22C 38/16* (2006.01)
(Continued)

(52) U.S. Cl.
CPC ..... *H01F 1/0577* (2013.01); *B22F 1/0003* (2013.01); *B22F 3/087* (2013.01);
(Continued)

(58) Field of Classification Search
CPC ..... H01F 1/057; H01F 1/0577
(Continued)

(56) References Cited

U.S. PATENT DOCUMENTS 5,431,747 A 7/1995 Takebuchi et al.
6,214,288 B1 4/2001 Kusunoki et al.
(Continued)

FOREIGN PATENT DOCUMENTS

CN 1166677 A 12/1997
CN 1335628 A 2/2002
(Continued)

OTHER PUBLICATIONS

Office Action issued in Chinese Application No. 201480053744.8; dated Dec. 27, 2016, with English Translation (24 pages).
(Continued)

*Primary Examiner* — Brian D Walck
(74) *Attorney, Agent, or Firm* — Cooper Legal Group, LLC

(57) ABSTRACT

The present invention discloses a low-B rare earth magnet. The rare earth magnet contains a main phase of $R_2T_{14}B$ and comprises the following raw material components: 13.5 at %~4.5 at % of R, 5.2 at %~5.8 at % of B, 0.3 at %~0.8 at % of Cu, 0.3 at %~3 at % of Co, and the balance being T and inevitable impurities, the R being at least one rare earth element comprising Nd, and the T being an element mainly comprising Fe. 0.3~0.8 at % of Cu and an appropriate amount of Co are co-added into the rare earth magnet, so that three Cu-rich phases formed in the grain boundary, and the magnetic effect of the three Cu-rich phases existing in the grain boundary and the solution of the problem of insufficient B in the grain boundary can obviously improve the squareness and heat-resistance of the magnet.

12 Claims, 1 Drawing Sheet

(51) Int. Cl.

| | |
|---|---|
| ***B22F 1/00*** | (2006.01) |
| ***B22F 3/087*** | (2006.01) |
| ***B22F 3/16*** | (2006.01) |
| ***C21D 8/12*** | (2006.01) |
| ***C21D 9/00*** | (2006.01) |
| ***C22C 33/04*** | (2006.01) |
| ***C22C 38/00*** | (2006.01) |
| ***C22C 38/02*** | (2006.01) |
| ***C22C 38/06*** | (2006.01) |
| ***C22C 38/10*** | (2006.01) |
| ***C22C 38/04*** | (2006.01) |
| ***C22C 38/20*** | (2006.01) |
| ***C22C 38/30*** | (2006.01) |
| ***C22C 38/32*** | (2006.01) |
| ***C22C 33/02*** | (2006.01) |
| *B22F 9/04* | (2006.01) |

(52) U.S. Cl.
CPC ..... *B22F 3/16* (2013.01); *C21D 8/1244* (2013.01); *C21D 9/0068* (2013.01); *C22C 33/0278* (2013.01); *C22C 33/04* (2013.01); *C22C 38/002* (2013.01); *C22C 38/005* (2013.01); *C22C 38/007* (2013.01); *C22C 38/008* (2013.01); *C22C 38/02* (2013.01); *C22C 38/04* (2013.01); *C22C 38/06* (2013.01); *C22C 38/10* (2013.01); *C22C 38/16* (2013.01); *C22C 38/20* (2013.01); *C22C 38/30* (2013.01); *C22C 38/32* (2013.01); *B22F 9/04* (2013.01); *B22F 2201/10* (2013.01); *B22F 2201/20* (2013.01); *B22F 2301/355* (2013.01); *B22F 2998/10* (2013.01); *B22F 2999/00* (2013.01); *C22C 2202/02* (2013.01); *H01F 1/0571* (2013.01)

(58) Field of Classification Search
USPC ..... 148/302
See application file for complete search history.

(56) References Cited

U.S. PATENT DOCUMENTS

| | | | |
|---|---|---|---|
| 8,152,936 | B2 | 4/2012 | Tsubokura et al. |
| 2011/0171056 | A1 | 7/2011 | Chrysopoulo et al. |

FOREIGN PATENT DOCUMENTS

| | | | |
|---|---|---|---|
| CN | 1409332 | A | 4/2003 |
| CN | 101256859 | A | 9/2008 |
| CN | 101320609 | A | 12/2008 |
| CN | 101325109 | A | 12/2008 |
| CN | 102511071 | A | 6/2012 |
| CN | 102956337 | A | 3/2013 |
| CN | 103123839 | A | 5/2013 |
| CN | 103842112 | A | 6/2014 |
| CN | 103903823 | A | 7/2014 |
| DE | 19945942 | A1 | 4/2001 |
| EP | 1164599 | A2 | 12/2001 |
| EP | 2740551 | A1 | 6/2014 |
| JP | H06340902 | A | 12/1994 |
| JP | 1995045412 | A | 2/1995 |
| JP | 2000303153 | A | 10/2000 |
| JP | 2002059245 | A | 2/2002 |
| JP | 2008214747 | A | 9/2008 |
| JP | 2008231535 | A | 10/2008 |
| JP | 2013070062 | A | 4/2013 |
| JP | 2013110387 | A | 6/2013 |
| JP | 2014132628 | A | 7/2014 |
| WO | 2009/150843 | A1 | 12/2009 |
| WO | 2009004994 | A1 | 8/2010 |
| WO | 2013122256 | A1 | 5/2015 |

OTHER PUBLICATIONS

Office Action issued in Japanese Application No. 2016-535145; dated Jul. 3, 2017, with English Translation (10 pages).
International Search Report and Written Opinion dated Feb. 26, 2015 in corresponding International application No. PCT/CN2014/092225 (5 pages).
European Search Report in corresponding European application, application No. 14866431 dated Jul. 21, 2017.
First Chinese Office Action cited in Chinese Application No. 201410369180.0 dated Dec. 21, 2016, 7 pgs.
EP Search Report cited in EP Application No. 15826755.9 dated Nov. 27, 2017, 10 pgs.
Japanese Office Action cited in Japanese Application No. 2016-560501 dated Oct. 30, 2017, 7 pgs.
Japanese Office Action cited in Japanese Application No. 2017-505079 dated Mar. 27, 2018, 4 pgs.
Int. Search Report cited in PCT Application No. PCT/CN2015/075512 dated Jul. 6, 2016, 6 pgs.
Int. Search Report cited in PCT Application No. PCT/CN2015/08555 dated Nov. 11, 2015, 8 pgs.
Non-Final Office Action cited in U.S. Appl. No. 15/328,258 dated May 18, 2018, 24 pgs.

LOW-B BARE EARTH MAGNET

FIELD OF THE INVENTION

The present invention relates to the field of magnet manufacturing technology, and in particular to a low-B rare earth magnet.

BACKGROUND OF THE INVENTION

As for high-property magnet with $(BH)_{max}$ exceeding 40 MGOe used in various high-performance electric motor or electric generator, it is extraordinarily necessary for the development of "low-B component magnet" by decreasing the usage of non-magnetic element B in order to obtain a highly magnetization magnet.

At present, the development of "low-B component magnet" has adopted various manners; however, no corresponding marketized product has been developed yet. The greatest disadvantage of "low-B component magnet" lies in the deterioration of the squareness (also known as $H_k$ or SQ) of the demagnetizing curve. The reason is rather complicated, which is mainly owing to the partial lack of B in the grain boundary caused by the existence of $R_2Fe_{17}$ phase and the lack of B-rich phase ($R_{1.1}T_4B_4$ phase).

Japanese published patent 2013-70062 discloses a low-B rare earth magnet, which comprises R (the R is at least one rare earth element comprising Y, Nd is an essential component), B, Al, Cu, Zr, Co, O, C and Fe as the principal component, the content of each element is: 25~34 weight % of R, 0.87~0.94 weight % of B, 0.03~03 weight % of Al, 0.03~0.11 weight % of Cu, 0.03~0.25 weight % of Zr, less than 3 weight % of Co (does not contain 0 at %), 0.03~0.1 weight % of O, 0.03~0.15 weight % of C, and the balance being Fe. In the invention, by decreasing the content of B, the content of B-rich phase is decreased accordingly, thus increasing the volume ratio of the main phase and finally obtaining a magnet with a high Br. Normally, when the content of B is decreased, $R_2T_{17}$ phase with soft magnetic property (generally $R_2T_{17}$ phase) would be formed, the coercivity ($H_{cj}$) of the magnet would be extremely easily decreased consequently. But in the invention by adding minor amounts of Cu, the precipitation of $R_2T_{17}$ phase is suppressed, and further forming $R_2T_{14}C$ phase (generally $R_2Fe_{14}C$ phase) which improves $H_{cj}$ and Br.

However, the above stated invention still fails to solve the inherent problem of low squareness ($H_k/H_{cj}$, also known as SQ) of the low-B magnet; it can be seen from the embodiments of the invention, $H_k/H_{cj}$ of only a few embodiments of the invention exceeds 95%, $H_k/H_{cj}$ of most of the embodiments is around 90%, further none of the embodiments reach over 98%, only in terms of $H_k/H_{cj}$, it is usually difficult to satisfy the requirements of the customer.

To explain it in detail, if the squareness (SQ) deteriorates, the heat-resistance of the magnet would also deteriorate consequently even when the coercivity of the magnet is rather high.

Thermal demagnetization of magnet happens when the electric motor rotates in high load, consequently the electric motor could not rotate gradually, further stop working. Therefore, there are a lot of reports related to develop a high coercivity magnet with "low-B component magnet", however, the squareness of all of the above stated magnet is not satisfying, which may not solve the problem of thermal demagnetization in the actual heat-resistance experiment of the electric motor.

In conclusion, no precedent of a "low-B component magnet" becomes the product actually accepted by the market.

On the other hand, the maximum magnetic energy product of Sm—Co serial magnet is approximately below 39 MGOe, therefore the NdFeB serial sintered magnet with the maximum magnetic energy product of 35~40 MGOe selected as the magnets for the electric motor or electric generator would occupy a large market share. Especially on the basis of reducing the $CO_2$ emission and the crisis of oil depletion, the pursuit of high efficiency and power-saving characteristics of the electric motor or electric generator is more and more severe, and the requirement for maximum magnetic energy product of the magnet for the electric motor and electric generator is higher and higher.

SUMMARY OF THE INVENTION

The objective of the present invention is to overcome the shortage of the conventional technique, and discloses a low-B rare earth magnet, in the present invention, 0.3~0.8 at % of Cu and an appropriate amount of Co are co-added into the rare earth magnet, so that three Cu-rich phases are formed in the grain boundary, and the magnetic effect of the three Cu-rich phases existing in the grain boundary and the solution of the problem of insufficient B in the grain boundary can obviously improve the squareness and heat-resistance of the magnet.

The present invention discloses:

a low-B rare earth magnet, the rare earth magnet contains a main phase $R_2T_{14}B$ and comprises the following raw material components:

13.5 at %~14.5 at % of R, 5.2 at %~5.8 at % of B, 0.3 at %~0.8 at % of Cu, 0.3 at %~3 at % of Co, and the balance being T and inevitable impurities, the R comprising at least one rare earth element including Nd, and the T being the elements mainly comprising Fe.

The at % of the present invention is atomic percent.

The rare earth elements of the present invention includes yttrium element.

In a preferred embodiment, the T further comprises X, wherein the X being at least three elements selected from Al, Si, Ga, Sn, Ge, Ag, Au, Bi, Mn, Cr, P or S, and the total content of the X is 0 at %~1.0 at %.

During the manufacturing process, a few amount of impurities such as O, C, N and other impurities are inevitably mixed. Therefore, the oxygen content of the rare earth magnet of the present invention is preferably below 1 at %, below 0.6 at % is more preferred, the content of C is also preferably controlled below 1 at %, below 0.4 at % is more preferred, and the content of N is controlled below 0.5 at %.

In a preferred embodiment, the rare earth magnet is manufactured by the following processes: a process of preparing a rare earth alloy for magnet with molten rare earth magnet components; processes of producing a fine powder by coarsely crushing and finely crushing the rare earth alloy for magnet; and processes of producing a compact by magnetic field compacting method, sintering the compact in vacuum or inert gas at a temperature of 900° C.~1100° C., forming a high-Cu crystal phase, a moderate Cu content crystal phase and a low-Cu crystal phase in a grain boundary.

By the above stated manners, the high-Cu crystal phase, the moderate Cu content crystal phase and the low-Cu crystal phase are formed in the grain boundary, so the squareness exceeds 95%, and the heat-resistance of the magnet is improved.

In a preferred embodiment, the molecular composition of the high-Cu crystal phase is $RT_2$ series, the molecular composition of the moderate Cu content crystal phase is $R_6T_{13}X$ series, the molecular composition of the low-Cu crystal phase is $RT_5$ series, the total amount of the high-Cu crystal phase and the moderate Cu content crystal phase is over 65 volume % of the grain boundary composition.

What needs to be explained is that a low-oxygen environment is needed for the manufacturing processes of the magnet to obtain the asserted effect in the present invention. As the low-oxygen manufacturing process of the magnet is a conventional technique, and the low-oxygen manufacturing manner is adopted for embodiment 1 to embodiment 7 of the present invention, no more relevant detailed description here.

In a preferred embodiment, the rare earth magnet is a magnet of Nd—Fe—B series with a maximum magnetic energy product over 43 MGOe.

In a preferred embodiment, the X comprises at least three elements selected from Al, Si, Ga, Sn, Ge, Ag, Au, Bi, Mn, Cr, P or S, and the total content of X is preferably 0.3 at %~1.0 at %.

In a preferred embodiment, the content of Dy, Ho, Gd or Tb is below 1 at % of the R.

In a preferred embodiment, the X comprises Ga, the content of Ga is 0.1 at %-0.2 at %.

In a preferred embodiment, the alloy for rare earth magnet is obtained by treating the molten raw material alloy by strip casting method, and being cooled at a cooling rate of over $10^{2°}$ C./s and below $10^{4°}$ C./s.

In a preferred embodiment, the coarse crushing process is a process of treating the alloy for rare earth magnet by hydrogen decrepitation to obtain coarse powder, the fine crushing process is a process of jet milling the coarse powder and further including a process of removing at least one part of the powder with a particle size of below 1.0 μm after the fine crushing process, so that the volume of the powder with a particle size of below 1.0 μm is reduced below 10% of the volume of whole powder.

The present invention further discloses another low-B rare earth magnet.

A low-B rare earth magnet, the rare earth magnet contains main phase of $R_2T_{14}B$ and comprises the following raw material components:

13.5 at %~14.5 at % of R, 5.2 at %~5.8 at % of B, 0.3 at %~0.8 at % of Cu, 0.3 at %~3 at % of Co, and the balance being T and inevitable impurities, the R being at least one rare earth element including Nd, and the T being an element mainly comprising Fe;

and the magnet being manufactured by the following steps:

a process of preparing an alloy for rare earth magnet by melting rare earth magnet components; processes of producing a fine powder by coarsely crushing and finely crushing the alloy for rare earth magnet; and processes of obtaining a compact by magnetic field compacting method, sintering the compact in vacuum or inert gas at a temperature of 900° C.~1100° C., forming a high-Cu crystal phase, a moderate Cu content crystal phase and a low-Cu crystal phase in a grain boundary, and performing heavy rare earth elements (RH) grain boundary diffusion at a temperature of 700° C.~1050° C.

In a preferred embodiment, the RH is selected from Dy, Ho or Tb, the T further comprises X, the X being at least three elements selected from Al, Si, Ga, Sn, Ge, Ag, Au, Bi, Mn, Cr, P or S, the total content of the X is 0 at %~1.0 at %; in the inevitable impurities, the content of O is controlled below 1 at %, the content of C is controlled below 1 at % and the content of N is controlled below 0.5 at %.

In a preferred embodiment, further comprising a step of aging treatment: treating the magnet after the RH grain boundary diffusion treatment at a temperature of 400° C.~650° C.

Compared with the conventional technique, the present invention has the following advantages:

1) The present invention adds appropriate content of Co, consequently the soft magnetic phase $R_2Fe_{17}$ is transferred into the intermetallic compounds such as $RCo_2$, $RCo_3$ and so on. However, it is already known that $H_{cj}$ and SQ would further decrease if the element Co is added singly. Therefore, the present invention co-adds 0.3 at %~0.8 at % of Cu, so that three Cu-rich phases form in the grain boundary, and the magnetic effect of the three Cu-rich phases existing in the grain boundary and the solution of the problem of insufficient B in the grain boundary can obviously improve the squareness and heat-resistance of the magnet. Moreover, a low-B magnet with a maximum magnetic energy product of exceeding 43 MGOe, high squareness and high heat-resistance is obtained.

2) Previously, for the magnet with the content of B less than 6 at %, as α-Fe phase is formed and the soft magnetic phase $R_2T_{17}$ is formed on the surface of the main phase or in the crystal grain boundary phase, and recent reports state that dhcp R-rich phase with a low oxygen content among the R-rich phases may improve coercivity, and some fcc R-rich phase with oxygen solid solution is the reason for decreasing coercivity, however, the R-rich phase is very easily oxidized, the phenomenon of deterioration or oxidization would happen even during sample analysis. Therefore its analysis is difficult and its specific condition is still unclear. In contrast, the inventor of the present invention leads a comprehensive research based on the opinions of slight adjustment of the basic component, minor impurities control, and the composition of crystal grain boundary control for increasing the integral squareness. As a result, the squareness of "low-B composition magnet" is improved only by simultaneously controlling the content of R, B, Co and Cu.

3) In the composition of the present invention, by adding minor amounts of Cu, Co and other impurities, the melting point of the intermetallic compounds with a high melting point such as $RCo_2$ phase (950° C.), $RCu_2$(840° C.) etc is reduced, consequently, all of the crystal grain boundaries are melted at the grain boundary diffusion temperature, the efficiency of the grain boundary diffusion is extraordinarily excellent, and the coercivity is improved to an unparalleled extent, moreover, as the squareness reaches over 96%, a high-property magnet with a favorable heat-resistance property is obtained.

DETAILED DESCRIPTION OF PREFERRED EMBODIMENTS

Figure 1:
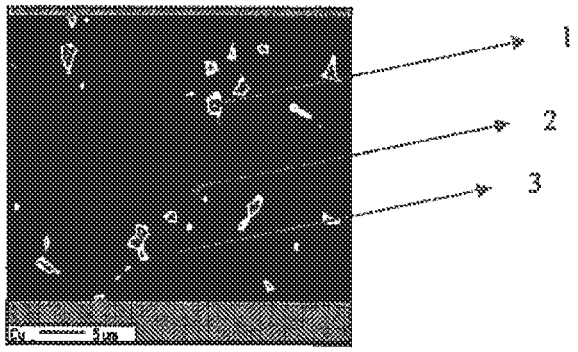
FIG. 1 illustrates an EPMA detection result of a sintered magnet of embodiment 1 of embodiment 1.

The present invention will be further described with the embodiments.

Embodiment I

Raw material preparing process: preparing Nd with 99.5% purity, industrial Fe—B, industrial pure Fe, Co with 99.9% purity, and Cu, Al and Si respectively with 99.5% purity; being counted in atomic percent at %.

The content of each element is shown in TABLE 1:

TABLE 1

| | proportion of each element | | | | | | |
|---|---|---|---|---|---|---|---|
| Composition | Nd | Co | B | Cu | Al | Si | Fe |
| Comparing sample 1 | 13.0 | 1.0 | 5.5 | 0.5 | 0.5 | 0.1 | remainder |
| Comparing sample 2 | 13.2 | 1.0 | 5.5 | 0.5 | 0.5 | 0.1 | remainder |
| Embodiment 1 | 13.5 | 1.0 | 5.5 | 0.5 | 0.5 | 0.1 | remainder |
| Embodiment 2 | 13.8 | 1.0 | 5.5 | 0.5 | 0.5 | 0.1 | remainder |
| Embodiment 3 | 14.0 | 1.0 | 5.5 | 0.5 | 0.5 | 0.1 | remainder |
| Embodiment 4 | 14.2 | 1.0 | 5.5 | 0.5 | 0.5 | 0.1 | remainder |
| Embodiment 5 | 14.5 | 1.0 | 5.5 | 0.5 | 0.5 | 0.1 | remainder |
| Comparing sample 3 | 15.0 | 1.0 | 5.5 | 0.5 | 0.5 | 0.1 | remainder |
| Comparing sample 4 | 15.2 | 1.0 | 5.5 | 0.5 | 0.5 | 0.1 | remainder |

Preparing 100 Kg raw material of each sequence number group by weighing respectively, in accordance with TABLE 1.

Melting process: placing the prepared raw material of one group into an aluminum oxide made crucible at a time, performing a vacuum melting in an intermediate frequency vacuum induction melting furnace in $10^{-2}$ Pa vacuum and below 1500° C.

Casting process: after the process of vacuum melting, filling Ar gas into the melting furnace until the Ar pressure reaches 50000 Pa, then obtaining a quenching alloy by being casted by single roller quenching method at a quenching speed of $10^{2}$° C./s~$10^{4}$° C./s, thermal preservation treating the quenching alloy at 600° C. for 60 minutes, and then being cooled to room temperature.

Hydrogen decrepitation process: at room temperature, vacuum pumping the hydrogen decrepitation furnace with the quenching alloy, then filling hydrogen with 99.5% purity into the furnace until the pressure reaches 0.1 MPa, after the alloy being placed for 120 minutes, vacuum pumping and heating at the same time, vacuum pumping at 500° C. for 2 hours, then being cooled, and the powder treated after hydrogen decrepitation process being taken out.

Fine crushing process: performing jet milling to the powder after hydrogen decrepitation in the crushing room under a pressure of 0.4 MPa and in the atmosphere of oxidizing gas below 100 ppm, then obtaining fine powder with an average particle size of 4.5 μm. The oxidizing gas means oxygen or water.

Screening partial fine powder after the fine crushing process (occupies 30% of the total fine powder by weight), then mixing the screened fine powder and the unscreened fine powder. The amount of powder which has a particle size smaller than 1.0 μm reduce to less than 10% of total powder by volume in the mixed fine powder.

Methyl caprylate is added into the powder after jet milling, the additive amount is 0.2% of the mixed powder by weight, further the mixture is comprehensively mixed by a V-type mixer.

Compacting process under a magnetic field: a vertical orientation magnetic field molder being used, compacting the powder added with methyl caprylate in once to form a cube with sides of 25 mm in an orientation field of 1.8 T and under a compacting pressure of 0.2 ton/cm$^2$, then demagnetizing the once-forming cube in a 0.2 T magnetic field.

The once-forming compact is sealed so as not to expose to air, the compact is secondly compacted by a secondary compact machine (isostatic pressing compacting machine) under a pressure of 1.4 ton/cm$^2$.

Sintering process: moving each of the compact into the sintering furnace, firstly sintering in a vacuum of $10^{-3}$ Pa and then maintained at 200° C. and at 900° C. respectively, then sintering for 2 hours at 1030° C., after that filling Ar gas into the sintering furnace until the Ar pressure reaches 0.1 MPa, then being cooled to room temperature.

Heat treatment process: annealing the sintered magnet for 1 hour at 620° C. in the atmosphere of high purity Ar gas, then being cooled to room temperature and taken out.

Machining process: machining the sintered magnet after heat treatment as a magnet with ϕ15 mm diameter and 5 mm thickness, the 5 mm direction being the orientation direction of the magnetic field.

Magnetic property evaluation process: testing the sintered magnet by NIM-10000H type nondestructive testing system for BH large rare earth permanent magnet from National Institute of Metrology.

Thermal demagnetization evaluation process: firstly testing the magnetic flux of the sintered magnet, heating the sintered magnet in the air at 100° C. for 1 hour, secondly testing the magnetic flux after being cooled; wherein the sintered magnet with a magnetic flux retention rate of above 95% is determined as a qualified product.

The magnetic property of the magnets manufactured by the sintered body for comparing samples 1~4 and embodiments 1~5 are directly tested without grain boundary diffusion treatment. The evaluation results of the magnets of the embodiments and the comparing samples are shown in table 2.

TABLE 2

| | magnetic property evaluation of the embodiments and the comparing samples | | | | | |
|---|---|---|---|---|---|---|
| NO. | Br (KGs) | $H_{cj}$ (KOe) | SQ (%) | $(BH)_{max}$ (MGOe) | BHH | Retention rate of the magnetic flux (%) |
| Comparing sample 1 | 14.92 | 10.4 | 85.6 | 52.1 | 62.5 | 88.0 |
| Comparing sample 2 | 14.51 | 11.32 | 88.3 | 51.2 | 62.52 | 90.5 |
| Embodiment 1 | 14.70 | 13.35 | 96.7 | 50.7 | 64.05 | 95.2 |
| Embodiment 2 | 14.58 | 14.20 | 98.4 | 49.8 | 64.00 | 96.2 |
| Embodiment 3 | 14.52 | 14.68 | 99.4 | 49.1 | 63.78 | 97.5 |
| Embodiment 4 | 14.39 | 14.43 | 99.6 | 48.7 | 63.13 | 97.2 |
| Embodiment 5 | 14.30 | 15.23 | 97.2 | 47.9 | 63.13 | 98.5 |
| Comparing sample 3 | 14.21 | 13.28 | 93.4 | 47.3 | 60.58 | 94.7 |
| Comparing sample 4 | 13.98 | 13.45 | 87.5 | 46.1 | 59.55 | 94.1 |

In the manufacturing process, special attention is paid to the control of the contents of O, C and N, and the contents of the three elements O, C, and N are controlled below 0.3 at %, 0.4 at % and 0.1 at %, respectively.

In conclusion, in the present invention, when the content of R is less than 13.5 at %, SQ and $H_{cj}$ would decrease, this is because the reduction of R-rich phase leads to the existence of grain boundary phase without R-rich phase. Contrarily, when the content of R exceeds 14.5 at %, SQ would decrease, which is due to the existence of surplus R-rich phase in the grain boundary, and SQ would decrease similar to the conventional technique.

Testing the Cu component of the sintered magnet according to embodiment 1 with FE-EPMA (Field emission-electron probe micro-analyzer), the results are shown in FIG. 1.

Numeral 1 in FIG. 1 represents high-Cu crystal phase, the molecular formula of the high-Cu crystal phase is $RT_2$ series, numeral 2 represents moderate Cu content crystal phase, the molecular formula of the moderate Cu content crystal phase is $R_6T_{13}X$ series, numeral 3 represents low-Cu crystal phase.

Figure 2:
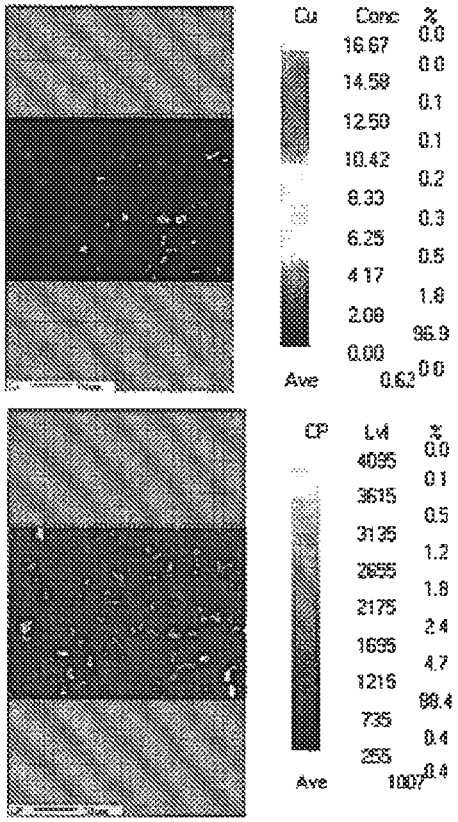
FIG. 2 illustrates an EPMA content detection result of a sintered magnet of embodiment 1 of embodiment I.

Calculated from FIG. 2, the content of the high-Cu crystal phase and the moderate Cu content crystal phase is over 65 volume % of the grain boundary composition.

Similarly, testing embodiments 2~5 with FE-EPMA, the content of the high-Cu crystal phase and the moderate Cu content crystal phase is over 65 volume % of the grain boundary composition by calculation.

What needs to be explained is that BHH stated by the present embodiment is the sum of $(BH)_{max}$ and $H_{cj}$, the concept of BHH stated by embodiments 2~7 is the same.

Embodiment II

Raw material preparing process: preparing Nd with 99.5% purity, Fe with 99.9% purity, Co with 99.9% purity, and Cu, Al, Ga and Si respectively with 99.5% purity; being counted in atomic percent at %.

The contents of each element are shown in TABLE 3:

TABLE 3

| | proportioning of each element | | | | | | | |
|---|---|---|---|---|---|---|---|---|
| Composition | Nd | Co | B | Cu | Al | Ga | Si | Fe |
| Comparing sample 1 | 14 | 2 | 4.8 | 0.4 | 0.4 | 0.1 | 0.1 | remainder |
| Comparing sample 2 | 14 | 2 | 5 | 0.4 | 0.4 | 0.1 | 0.1 | remainder |
| Embodiment 1 | 14 | 2 | 5.2 | 0.4 | 0.5 | 0.1 | 0.1 | remainder |
| Embodiment 2 | 14 | 2 | 5.4 | 0.4 | 0.4 | 0.1 | 0.1 | remainder |
| Embodiment 3 | 14 | 2 | 5.6 | 0.4 | 0.4 | 0.1 | 0.1 | remainder |
| Embodiment 4 | 14 | 2 | 5.8 | 0.4 | 0.4 | 0.1 | 0.1 | remainder |
| Comparing sample 3 | 14 | 2 | 6 | 0.4 | 0.4 | 0.1 | 0.1 | remainder |
| Comparing sample 4 | 14 | 2 | 6.2 | 0.4 | 0.4 | 0.1 | 0.1 | remainder |

Preparing 100 Kg raw material of each sequence number group by weighing respectively, in accordance with TABLE 3.

Melting process: placing the prepared raw material of one group into an aluminum oxide made crucible at a time, performing a vacuum melting in an intermediate frequency vacuum induction melting furnace in $10^{-2}$ Pa vacuum and below 1500° C.

Casting process: after the process of vacuum melting, filling Ar gas into the melting furnace until the Ar pressure reaches 50000 Pa, then obtaining a quenching alloy by being casted with single roller quenching method at a quenching speed of 10° C./s~$10^{4}$° C./s, thermal preservation treating the quenching alloy at 600° C. for 60 minutes, and then being cooled to room temperature.

Hydrogen decrepitation process: at room temperature, vacuum pumping the hydrogen decrepitation furnace placed with the quenching alloy, then filling hydrogen with 99.5% purity into the furnace until the pressure reaches 0.1 MPa, after the alloy being placed for 125 minutes, vacuum pumping and heating at the same time, performing the vacuum pumping at 500° C. for 2 hours, then being cooled, and the powder treated after hydrogen decrepitation process being taken out.

Fine crushing process: performing jet milling to the powder after hydrogen decrepitation in the crushing room under a pressure of 0.41 MPa and in the atmosphere of oxidizing gas below 100 ppm, then obtaining fine powder with an average particle size of 4.30 μm of fine powder. The oxidizing gas means oxygen or water.

Screening partial fine powder which is treated after the fine crushing process (occupies 30%/o of the total fine powder by weight), removing the powder with a particle size of smaller than 1.0 μm, then mixing the screened fine powder and the remaining unscreened fine powder. The amount of the powder which has a particle size smaller than 1.0 μm is reduced to less than 10% of total powder by volume in the mixed fine powder.

Methyl caprylate is added into the powder treated after jet milling, the additive amount is 0.25% of the mixed powder by weight, further the mixture is comprehensively mixed by a V-type mixer.

Compacting process under a magnetic field: a vertical orientation type magnetic field molder being used, compacting the powder added with methyl caprylate in once to form a cube with sides of 25 mm in an orientation field of 1.8 T and under a compacting pressure of 0.2 ton/$cm^2$, then demagnetizing the once-forming cube in a 0.2 T magnetic field.

The once-forming compact is sealed so as not to expose to air, the compact is secondly compacted by a secondary compact machine (isostatic pressing compacting machine) under a pressure of 1.4 ton/$cm^2$.

Sintering process: moving each of the compact to the sintering furnace, firstly sintering in a vacuum of $10^{-3}$ Pa and respectively maintained for 2 hours at 200° C. and for 2 hours at 900° C., respectively, then sintering for 2 hours at 1000° C., after that filling Ar gas into the sintering furnace until the Ar pressure reaches 0.1 MPa, then being cooled to room temperature.

Heat treatment process: annealing the sintered magnet for 1 hour at 620° C. in the atmosphere of high purity Ar gas, then being cooled to room temperature and taken out.

Machining process: machining the sintered magnet after heat treatment as a magnet with ϕ15 mm diameter and 5 mm thickness, the 5 mm direction being the orientation direction of the magnetic field.

Magnetic property evaluation process: testing the sintered magnet by NIM-10000H type nondestructive testing system for BH large rare earth permanent magnet from National Institute of Metrology.

Thermal demagnetization evaluation process: firstly testing the magnetic flux of the sintered magnet, heating the sintered magnet in the air at 100° C. for 1 hour, secondly testing the magnetic flux after being cooled; wherein the sintered magnet with a magnetic flux retention rate of above 95% is determined as a qualified product.

The magnetic property of the magnets manufactured by the sintered body for comparing samples 1~4 and embodiments 1~5 are directly tested without grain boundary diffusion treatment. The evaluation results of the magnets of the embodiments and the comparing samples are shown in TABLE 4.

TABLE 4 magnetic property evaluation of the embodiments and the comparing samples

| NO. | Br (KGs) | $H_{cj}$ (KOe) | SQ (%) | $(BH)_{max}$ (MGOe) | BHH | Retention rate of the magnetic flux (%) |
|---|---|---|---|---|---|---|
| Comparing sample 1 | 14.71 | 11.87 | 82.4 | 50.64 | 62.51 | 85.5 |
| Comparing sample 2 | 14.67 | 12.38 | 88.5 | 50.35 | 62.73 | 90.1 |
| Embodiment 1 | 14.63 | 13.34 | 97.4 | 50.06 | 63.40 | 95.2 |
| Embodiment 2 | 14.58 | 13.83 | 99.2 | 49.71 | 63.54 | 96.8 |
| Embodiment 3 | 14.53 | 14.17 | 99.5 | 49.39 | 63.56 | 97.5 |
| Embodiment 4 | 14.48 | 13.99 | 96.7 | 49.07 | 63.06 | 96.8 |
| Comparing sample 3 | 13.43 | 14.79 | 96.2 | 43.74 | 58.53 | 98.6 |
| Comparing sample 4 | 13.39 | 14.78 | 96.2 | 43.43 | 58.21 | 98.4 |

In the manufacturing process, special attention is paid to the control of the contents of O, C and N, and the contents of the three elements O, C, and N are controlled below 0.4 at %, 0.3 at % and 0.2 at %, respectively.

In conclusion, when the content of B is less than 5.2 at %, SQ would decrease sharply, this is because the reducing of the content of B leads to SQ decrease as same as the conventional technique. Contrarily, when the content of B exceeds 5.8 at %, SQ would decrease, the sintering property would decrease sharply, and the sintered density may not be sufficient, therefore Br and $(BH)_{max}$ would decrease and one may not obtain a magnet with high magnetic energy product.

Similarly, testing embodiments 1~4 with FE-EPMA, the content of the high-Cu crystal phase and the moderate Cu content crystal phase is over 65 volume % of the grain boundary composition by calculation.

Embodiment III

Raw material preparing process: preparing Nd with 99.5% purity, industrial Fe—B, industrial pure Fe, Co with 99.9% purity, and Cu with 99.5% purity; being counted in atomic percent at %.

The contents of each element are shown in TABLE 5:

TABLE 5 proportioning of each element

| Composition | Nd | Co | B | Cu | Fe |
|---|---|---|---|---|---|
| Comparing sample 1 | 14.0 | 1.0 | 5.5 | 0.2 | remainder |
| Embodiment 1 | 14.0 | 1.0 | 5.5 | 0.3 | remainder |
| Embodiment 2 | 14.0 | 1.0 | 5.5 | 0.4 | remainder |
| Embodiment 3 | 14.0 | 1.0 | 5.5 | 0.6 | remainder |
| Embodiment 4 | 14.0 | 1.0 | 5.5 | 0.8 | remainder |
| Comparing sample 2 | 14.0 | 1.0 | 5.5 | 1 | remainder |
| Comparing sample 3 | 14.0 | 1.0 | 5.5 | 1.2 | remainder |

Preparing 100 Kg raw material of each sequence number group by weighing respectively, in accordance with TABLE 5.

Melting process: placing the prepared raw material of one group into an aluminum oxide made crucible at a time, performing a vacuum melting in an intermediate frequency vacuum induction melting furnace in $10^{-2}$ Pa vacuum and below 1500° C.

Casting process: after the process of vacuum melting, filling Ar gas into the melting furnace until the Ar pressure reaches 50000 Pa, then obtaining a quenching alloy by being casted with single roller quenching method at a quenching speed of $10^{2}$° C./s~$10^{4}$° C./s, thermal preservation treating the quenching alloy at 600° C. for 60 minutes, and then being cooled to room temperature.

Hydrogen decrepitation process: at room temperature, vacuum pumping the hydrogen decrepitation furnace placed with the quenching alloy, then filling hydrogen with 99.5% purity into the furnace until the pressure reaches 0.1 MPa, after the alloy being placed for 97 minutes, vacuum pumping and heating at the same time, performing the vacuum pumping at 500° C. for 2 hours, then being cooled, and the powder treated after hydrogen decrepitation process being taken out.

Fine crushing process: performing jet milling to the powder after hydrogen decrepitation in the crushing room under a pressure of 0.42 MPa and in the atmosphere of below 100 ppm of oxidizing gas, then obtaining fine powder with an average particle size of 4.51 μm of fine powder. The oxidizing gas means oxygen or water.

Methyl caprylate is added into the powder treated after jet milling, the additive amount is 0.25% of the mixed powder by weight, further the mixture is comprehensively mixed by a V-type mixer.

Compacting process under a magnetic field: a vertical orientation magnetic field molder being used, compacting the powder added with methyl caprylate in once to form a cube with sides of 25 mm in an orientation field of 1.8 T and under a compacting pressure of 0.2 ton/$cm^2$, then demagnetizing the once-forming cube in a 0.2 T magnetic field.

The once-forming compact is sealed so as not to expose to air, the compact is secondly compacted by a secondary compact machine (isostatic pressing compacting machine) under a pressure of 1.4 ton/$cm^2$.

Sintering process: moving each of the compact into the sintering furnace, firstly sintering in a vacuum of $10^{-3}$ Pa and maintained for 2 hours at 200° C. and for 2 hours at 900° C., respectively; then sintering for 2 hours at 1020° C., after that filling Ar gas into the sintering furnace so that the Ar pressure reaches 0.1 MPa, then being cooled to room temperature.

Heat treatment process: annealing the sintered magnet for 1 hour at 620° C. in the atmosphere of high purity Ar gas, then being cooled to room temperature and taken out.

Machining process: machining the sintered magnet after heat treatment as a magnet with ϕ15 mm diameter and 5 mm thickness, the 5 mm direction being the orientation direction of the magnetic field.

Magnetic property evaluation process: testing the sintered magnet by NIM-10000H type nondestructive testing system for BH large rare earth permanent magnet from National Institute of Metrology.

Thermal demagnetization evaluation process: firstly testing the magnetic flux of the sintered magnet, heating the sintered magnet in the air at 100° C. for 1 hour, secondly testing the magnetic flux after being cooled; wherein the sintered magnet with a magnetic flux retention rate of above 95% is determined as a qualified product.

The magnetic property of the magnets manufactured by the sintered body for comparing samples 1~3 and embodiments 1~4 are directly tested without grain boundary diffusion treatment. The evaluation results of the magnets of the embodiments and the comparing samples are shown in TABLE 6.

TABLE 6 magnetic property evaluation of the embodiments and the comparing samples

| NO. | Br (KGs) | $H_{cj}$ (KOe) | SQ (%) | $(BH)_{max}$ (MGOe) | BHH | Retention rate of the magnetic flux (%) |
|---|---|---|---|---|---|---|
| Comparing sample 1 | 14.58 | 13.01 | 86.3 | 49.74 | 62.75 | 92.5 |
| Embodiment 1 | 14.56 | 13.68 | 98.1 | 49.60 | 63.28 | 95.3 |
| Embodiment 2 | 14.54 | 14.24 | 99.2 | 49.64 | 63.88 | 97.1 |
| Embodiment 3 | 14.50 | 14.67 | 99.7 | 49.18 | 63.85 | 97.6 |
| Embodiment 4 | 14.46 | 14.99 | 99.2 | 48.90 | 63.89 | 97.8 |
| Comparing sample 2 | 14.42 | 13.32 | 96.8 | 48.62 | 61.94 | 94.3 |
| ComparingX sample 2 | 14.37 | 13.34 | 91.2 | 48.35 | 61.69 | 94.5 |

In the manufacturing process, special attention is paid to the control of the contents of O, C and N, and the contents of the three elements O, C, and N are controlled below 0.4 at %, 0.3 at % and 0.2 at %, respectively.

In conclusion, when the content of Cu is less than 0.3 at %, SQ would decrease sharply, this is because Cu has the effect of improving SQ essentially. Contrarily, when the content of Cu exceeds 0.8 at %, $H_{cj}$ and SQ would decrease, this is because the improving effect for $H_{cj}$ is saturated as the excessive addition of Cu, furthermore, other negative factors begins to affect the magnetic property, which worsen the phenomenon.

Similarly, testing embodiments 1~4 with FE-EPMA, the content of the high-Cu crystal phase and the moderate Cu content crystal phase is over 65 volume % of the grain boundary composition by calculation.

Embodiment IV

Raw material preparing process: preparing Nd with 99.5% purity, industrial Fe—B, industrial pure Fe, Co with 99.9% purity, and Cu, Al, Si and Cr respectively with 99.5% purity; being counted in atomic percent at %.

The contents of each element are shown in TABLE 7:

TABLE 7 proportioning of each element

| Composition | Nd | Co | B | Cu | Al | Si | Cr | Fe |
|---|---|---|---|---|---|---|---|---|
| Comparing sample 1 | 14.0 | 0.1 | 5.6 | 0.6 | 0.3 | 0.1 | 0.1 | remainder |
| Comparing sample 2 | 14.0 | 0.2 | 5.6 | 0.6 | 0.3 | 0.1 | 0.1 | remainder |
| Embodiment 1 | 14.0 | 0.3 | 5.6 | 0.6 | 0.3 | 0.1 | 0.1 | remainder |
| Embodiment 2 | 14.0 | 0.5 | 5.6 | 0.6 | 0.3 | 0.1 | 0.1 | remainder |
| Embodiment 3 | 14.0 | 1.0 | 5.6 | 0.6 | 0.3 | 0.1 | 0.1 | remainder |
| Embodiment 4 | 14.0 | 2.0 | 5.6 | 0.6 | 0.3 | 0.1 | 0.1 | remainder |
| Embodiment 5 | 14.0 | 3.0 | 5.6 | 0.6 | 0.3 | 0.1 | 0.1 | remainder |
| Comparing sample 3 | 14.0 | 4.0 | 5.6 | 0.6 | 0.3 | 0.1 | 0.1 | remainder |
| Comparing sample 4 | 14.0 | 6.0 | 5.6 | 0.6 | 0.3 | 0.1 | 0.1 | remainder |

Preparing 100 Kg raw material of each group by weighing respectively, in accordance with TABLE 7.

Melting process: placing the prepared raw material of one group into an aluminum oxide made crucible at a time, performing a vacuum melting in an intermediate frequency vacuum induction melting furnace in $10^{-2}$ Pa vacuum and below 1500° C.

Casting process: after the process of vacuum melting, filling Ar gas into the melting furnace until the Ar pressure reaches 50000 Pa, then obtaining a quenching alloy by being casted with single roller quenching method at a quenching speed of $10^{2}$° C./s~$10^{4}$° C./s, thermal preservation treating the quenching alloy at 600° C. for 60 minutes, and then being cooled to room temperature.

Hydrogen decrepitation process: at room temperature, vacuum pumping the hydrogen decrepitation furnace placed with the quenching alloy, then filling hydrogen with 99.5% purity into the furnace until the pressure reach 0.1 MPa, after the alloy being placed for 122 minutes, vacuum pumping and heating at the same time, performing the vacuum pumping at 500° C. for 2 hours, then being cooled, and the powder treated after hydrogen decrepitation process being taken out.

Fine crushing process: performing jet milling to the powder after hydrogen decrepitation in the crushing room under a pressure of 0.45 MPa and in the atmosphere of oxidizing gas below 100 ppm, then obtaining an average particle size of 4.29 μm of fine powder. The oxidizing gas means oxygen or water.

Screening partial fine powder which is treated after the fine crushing process (occupies 30% of the total fine powder by weight), removing the powder with a particle size of smaller than 1.0 μm, then mixing the screened fine powder and the remaining unscreened fine powder. The amount of powder which has a particle size smaller than 1.0 μm is reduced to less than 10% of total powder by volume in the mixed fine powder.

Methyl caprylate is added into the powder treated after jet milling, the additive amount is 0.22% of the mixed powder by weight, further the mixture is comprehensively mixed by a V-type mixer.

Compacting process under a magnetic field: a vertical orientation type magnetic field molder being used, compacting the powder added with methyl caprylate in once to form a cube with sides of 25 mm in an orientation field of 1.8 T and under a compacting pressure of 0.2 ton/cm$^2$, then demagnetizing the once-forming cube in a 0.2 T magnetic field.

The once-forming compact is sealed so as not to expose to air, the compact is secondly compacted by a secondary compact machine (isostatic pressing compacting machine) under a pressure of 1.4 ton/cm$^2$.

Sintering process: moving each of the compact to the sintering furnace, firstly sintering in a vacuum of $10^{-3}$ Pa and maintained for 2 hours at 200° C. and for 2 hours at 900° C., then sintering for 2 hours at 1010° C., respectively after that filling Ar gas into the sintering furnace until the Ar pressure reaches 0.1 MPa, then being cooled to room temperature.

Heat treatment process: annealing the sintered magnet for 1 hour at 620° C. in the atmosphere of high purity Ar gas, then being cooled to room temperature and taken out.

Machining process: machining the sintered magnet after heat treatment as a magnet with ϕ15 mm diameter and 5 mm thickness, the 5 mm direction being the orientation direction of the magnetic field.

Magnetic property evaluation process: testing the sintered magnet by NIM-10000H type nondestructive testing system for BH large rare earth permanent magnet from National Institute of Metrology.

Thermal demagnetization evaluation process: firstly testing the magnetic flux of the sintered magnet, heating the sintered magnet in the air at 100° C. for 1 hour, secondly testing the magnetic flux after being cooled; wherein the sintered magnet with a magnetic flux retention rate of above 95% is determined as a qualified product.

The magnetic property of the magnets manufactured by the sintered body in accordance with comparing samples 1~4 and embodiments 1~5 are directly tested without grain boundary diffusion treatment. The evaluation results of the magnets of the embodiments and the comparing samples are shown in TABLE 8.

TABLE 8 magnetic property evaluation of the embodiments and the comparing samples

| NO. | Br (KGs) | $H_{cj}$ (KOe) | SQ (%) | $(BH)_{max}$ (MGOe) | BHH | Retention rate of the magnetic flux (%) |
|---|---|---|---|---|---|---|
| Comparing sample 1 | 14.21 | 13.82 | 82.1 | 42.24 | 61.06 | 94.0 |
| Comparing sample 2 | 14.23 | 13.93 | 88.8 | 47.31 | 61.24 | 94.1 |
| Embodiment 1 | 14.25 | 15.65 | 96.5 | 47.42 | 63.07 | 96.5 |
| Embodiment 2 | 14.28 | 15.43 | 99.6 | 47.67 | 63.1 | 96.3 |
| Embodiment 3 | 14.3 | 15.53 | 99.5 | 47.84 | 63.37 | 96.5 |

TABLE 8-continued magnetic property evaluation of the embodiments and the comparing samples

| NO. | Br (KGs) | $H_{cj}$ (KOe) | SQ (%) | $(BH)_{max}$ (MGOe) | BHH | Retention rate of the magnetic flux (%) |
|---|---|---|---|---|---|---|
| Embodiment 4 | 14.29 | 15.47 | 99.4 | 47.64 | 63.11 | 96.5 |
| Embodiment 5 | 14.26 | 15.64 | 97.3 | 47.45 | 63.09 | 96.8 |
| Comparing sample 3 | 14.24 | 13.83 | 88.3 | 47.32 | 61.15 | 94.0 |
| Comparing sample 4 | 14.21 | 12.81 | 84.5 | 47.24 | 60.05 | 93.7 |

In the manufacturing process, special attention is paid to the control of the contents of O, C and N, and the contents of the three elements O, C, and N are controlled below 0.6 at %, 0.3 at % and 0.3 at %, respectively.

In conclusion, when the content of Co is less than 0.3 at %, $H_{cj}$ and SQ would decrease sharply, this is because the effect of improving $H_{cj}$ and SQ may be realized only if the R—Co intermetallic composition which existed in the grain boundary phase reaches a certain minimum amount. Contrarily, when the content of Co exceeds 3 at %, $H_{cj}$ and SQ would decrease sharply, this is because the other phases with the effect of reducing coercivity may be formed if the R—Co intermetallic composition existed in the grain boundary phase exceeds a fixed amount.

Similarly, testing embodiments 1~5 with FE-EPMA, the content of the high-Cu crystal phase and the moderate Cu content crystal phase is over 65 volume % of the grain boundary composition by calculation.

Embodiment V

Raw material preparing process: preparing Nd with 99.5% purity, industrial Fe—B, industrial pure Fe, Co with 99.9% purity, and Cu, Al, Ga, Si, Mn, Sn, Ge, Ag, Au and Bi respectively with 99.5% purity; being counted in atomic percent at %.

The contents of each element are shown in TABLE 9:

TABLE 9 proportioning of each element

| Composition | Nd | Co | B | Cu | Al | Ga | Si | Mn | Sn | Ge | Ag | Au | Bi | Fe |
|---|---|---|---|---|---|---|---|---|---|---|---|---|---|---|
| Comparing sample 1 | 13.6 | 3.0 | 5.7 | 0.6 | 0.3 | 0 | 0.1 | | | | | | | remainder |
| Comparing sample 2 | 13.6 | 3.0 | 5.7 | 0.6 | 0.2 | 0 | 0.1 | | | | | | | remainder |
| Embodiment 1 | 13.6 | 3.0 | 5.7 | 0.6 | 0.2 | 0.1 | 0.1 | | | | | | | remainder |
| Embodiment 2 | 13.6 | 3.0 | 5.7 | 0.6 | 0.2 | 0 | 0.1 | 0.1 | 0.3 | | | | | remainder |
| Embodiment 3 | 13.6 | 3.0 | 5.7 | 0.6 | 0.1 | 0.1 | 0.1 | 0.1 | | 0.4 | | | | remainder |
| Embodiment 4 | 13.6 | 3.0 | 5.7 | 0.6 | 0.1 | 0 | 0.1 | | | | 0.5 | | | remainder |
| Embodiment 5 | 13.6 | 3.0 | 5.7 | 0.6 | 0.1 | 0 | 0.1 | | | | | 0.5 | | remainder |
| Embodiment 6 | 13.6 | 3.0 | 5.7 | 0.6 | 0.1 | 0 | 0.1 | | | | | | 0.5 | remainder |
| Embodiment 7 | 13.6 | 3.0 | 5.7 | 0.6 | 0.1 | 0 | 0.1 | | 0.1 | | | | | remainder |
| Embodiment 8 | 13.6 | 3.0 | 5.7 | 0.6 | 0.2 | 0.1 | 0.2 | | | | | | | remainder |
| Comparing sample 3 | 13.6 | 3.0 | 5.7 | 0.6 | 0.1 | 0.2 | 0.1 | | 0.8 | | | | | remainder |
| Comparing sample 4 | 13.6 | 3.0 | 5.7 | 0.6 | 0.1 | 0.2 | 0.1 | | 0.2 | | | | 0.5 | remainder |

Preparing 100 Kg raw material of each group by weighing respectively in accordance with TABLE 9.

Melting process: placing the prepared raw material of one group into an aluminum oxide made crucible at a time, performing a vacuum melting in an intermediate frequency vacuum induction melting furnace in $10^{-2}$ Pa vacuum and below 1500° C.

After the process of vacuum melting, filling Ar gas into the melting furnace until the Ar pressure would reach 50000 Pa, then obtaining a quenching alloy by being casted by single roller quenching method at a quenching speed of $10^{2}$° C./s~$10^{4}$° C./s, thermal preservation treating the quenching alloy at 600° C. for 60 minutes, and then being cooled to room temperature.

Hydrogen decrepitation process: at room temperature, vacuum pumping the hydrogen decrepitation furnace placed with the quenching alloy, then filling hydrogen with 99.5% purity into the furnace until the pressure reach 0.1 MPa, after the alloy being placed for 109 minutes, vacuum pumping and heating at the same time, performing the vacuum pumping at 500° C. for 2 hours, then being cooled, and the powder treated after hydrogen decrepitation process being taken out.

Fine crushing process: performing jet milling to the powder after hydrogen decrepitation in the crushing room under a pressure of 0.41 MPa and in the atmosphere of below 100 ppm of oxidizing gas, then obtaining fine powder with an average particle size of 4.58 μm. The oxidizing gas means oxygen or water.

Screening partial fine powder which is treated after the fine crushing process (occupies 30% of the total fine powder by weight), removing the powder with a particle size of smaller than 1.0 μm, then mixing the screened fine powder and the unscreened fine powder. The amount of powder which has a particle size smaller than 1.0 μm is reduced to less than 10% of total powder by volume in the mixed fine powder.

Methyl caprylate is added into the powder treated after jet milling, the additive amount is 0.22% of the mixed powder by weight, further the mixture is comprehensively mixed by a V-type mixer.

Compacting process under a magnetic field: a vertical orientation magnetic field molder being used, compacting the powder added with methyl caprylate in once to form a cube with sides of 25 mm in an orientation field of 1.8 T and under a compacting pressure of 0.2 ton/cm$^2$, then demagnetizing the once-forming cube in a 0.2 T magnetic field.

The once-forming compact is sealed so as not to expose to air, the compact is secondly compacted by a secondary compact machine (isostatic pressing compacting machine) under a pressure of 1.4 ton/cm$^2$.

Sintering process: moving each of the compact to the sintering furnace, firstly sintering in a vacuum of $10^{-3}$ Pa and maintained for 2 hours at 200° C. and for 2 hours at 900° C., respectively; then sintering for 2 hours at 1010° C., after that filling Ar gas into the sintering furnace until the Ar pressure would reach 0.1 MPa, then being cooled to room temperature.

Heat treatment process: annealing the sintered magnet for 1 hour at 620° C. in the atmosphere of high purity Ar gas, then being cooled to room temperature and taken out.

Machining process: machining the sintered magnet after heat treatment as a magnet with ϕ15 mm diameter and 5 mm thickness, the 5 mm direction being the orientation direction of the magnetic field.

Magnetic property evaluation process: testing the sintered magnet by NIM-10000H type nondestructive testing system for BH large rare earth permanent magnet from National Institute of Metrology.

Thermal demagnetization evaluation process: firstly testing the magnetic flux of the sintered magnet, heating the sintered magnet in the air at 100° C. for 1 hour, secondly testing the magnetic flux after being cooled; wherein the sintered magnet with a magnetic flux retention rate of above 95% is determined as a qualified product.

The magnetic property of the magnets manufactured by the sintered body in accordance with comparing samples 1~4 and embodiments 1~8 are directly tested without grain boundary diffusion treatment. The evaluation results of the magnets of the embodiments and the comparing samples are shown in TABLE 10.

TABLE 10 magnetic property evaluation of the embodiments and the comparing samples

| NO. | Br (KGs) | $H_{cj}$ (KOe) | SQ (%) | $(BH)_{max}$ (MGOe) | BHH | Retention rate of the magnetic flux (%) |
|---|---|---|---|---|---|---|
| Comparing sample 1 | 14.58 | 12.98 | 83.4 | 49.73 | 62.71 | 94.2 |
| Comparing sample 2 | 14.56 | 12.78 | 86.7 | 49.26 | 62.04 | 94.3 |
| Embodiment 1 | 14.58 | 13.56 | 99.3 | 49.86 | 63.42 | 97.3 |
| Embodiment 2 | 14.65 | 13.45 | 99.4 | 50.42 | 63.87 | 97.0 |
| Embodiment 3 | 14.66 | 14.39 | 99.5 | 50.73 | 65.12 | 97.6 |
| Embodiment 4 | 14.63 | 14.54 | 99.3 | 50.53 | 65.07 | 97.8 |
| Embodiment 5 | 14.65 | 14.51 | 99.5 | 50.84 | 65.35 | 97.8 |
| Embodiment 6 | 14.62 | 14.52 | 99.5 | 50.73 | 65.25 | 98.0 |
| Embodiment 7 | 14.63 | 14.43 | 99.6 | 50.61 | 65.04 | 97.7 |
| Embodiment 8 | 14.54 | 14.36 | 99.4 | 49.56 | 63.92 | 97.6 |
| Comparing sample 3 | 14.36 | 14.40 | 93.9 | 48.20 | 62.60 | 95.5 |
| Comparing sample 4 | 14.27 | 14.23 | 94.2 | 47.60 | 61.83 | 95.6 |

In the manufacturing process, special attention is paid to the control of the contents of O, C and N, and the contents of the three elements O, C, and N are respectively controlled below 0.2 at %, 0.2 at % and 0.1 at %.

In conclusion, the using of more than 3 types of X is the most preferably, this is because the existence of minor amounts of impurity phase has an improving effect when the coercivity-improving phase is formed in the crystal grain boundary, meanwhile, when the content of X is less than 0.3 at %, coercivity and squareness may not be improved, however, when the content of X exceeds 1.0 at %, the improving effect for coercivity and squareness is saturated, furthermore, other phases having a negative effect for squareness is formed, consequently, SQ decrease occurred similarly.

Similarly, testing embodiments 1~8 with FE-EPMA, the content of the high-Cu crystal phase and the moderate Cu content crystal phase is over 65 volume % of the grain boundary composition by calculation.

Embodiment VI

Raw material preparing process: preparing Nd, Pr, Dy, Gd, Ho and Tb with 99.5% purity, industrial Fe—B, industrial pure Fe, Co with 99.9% purity, and Cu, Al, Ga, Si, Cr, Mn, Sn, Ge and Ag respectively with 99.5% purity; being counted in atomic percent at %.

The contents of each element are shown in TABLE 11:

TABLE 11

| | proportioning of each element | | | | | | | | | | | | | | | | | |
|---|---|---|---|---|---|---|---|---|---|---|---|---|---|---|---|---|---|---|
| Composition | Nd | Pr | Dy | Gd | Ho | Tb | Co | B | Cu | Al | Ga | Si | Cr | Mn | Sn | Ge | Ag | Fe |
| Embodiment 1 | 14.4 | | | | | | 1.5 | 5.4 | 0.7 | 0.1 | 0.2 | 0.1 | 0.1 | 0.1 | 0.1 | 0.1 | 0.1 | remainder |
| Embodiment 2 | 11.4 | 3.0 | | | | | 1.5 | 5.4 | 0.7 | 0.1 | 0.2 | 0.1 | 0.1 | 0.1 | 0.1 | 0.1 | 0.1 | remainder |
| Embodiment 3 | 13.4 | | 1.0 | | | | 1.5 | 5.4 | 0.7 | 0.1 | 0.2 | 0.1 | 0.1 | 0.1 | 0.1 | 0.1 | 0.1 | remainder |
| Embodiment 4 | 13.4 | | | 0.5 | | | 1.5 | 5.4 | 0.7 | 0.1 | 0.2 | 0.1 | 0.1 | 0.1 | 0.1 | 0.1 | 0.1 | remainder |
| Embodiment 5 | 13.4 | | | | 0.8 | | 1.5 | 5.4 | 0.7 | 0.1 | 0.2 | 0.1 | 0.1 | 0.1 | 0.1 | 0.1 | 0.1 | remainder |
| Embodiment 6 | 13.4 | | | | | 0.6 | 1.5 | 5.4 | 0.7 | 0.1 | 0.2 | 0.1 | 0.1 | 0.1 | 0.1 | 0.1 | 0.1 | remainder |

Preparing 100 Kg raw material of each sequence number group by weighing respectively, in accordance with TABLE 11.

Melting process: placing the prepared raw material of one group into an aluminum oxide made crucible at a time, performing a vacuum melting in an intermediate frequency vacuum induction melting furnace in $10^{-2}$ Pa vacuum and below 1500° C.

Casting process: after the process of vacuum melting, filling Ar gas into the melting furnace until the Ar pressure would reach 50000 Pa, then obtaining a quenching alloy by being casted with single roller quenching method at a quenching speed of $10^{2}$° C./s~$10^{4}$° C./s, thermal preservation treating the quenching alloy at 600° C. for 60 minutes, and then being cooled to room temperature.

Hydrogen decrepitation process: at room temperature, vacuum pumping the hydrogen decrepitation furnace placed with the quenching alloy, then filling hydrogen with 99.5% purity into the furnace until the pressure reach 0.1 MPa, after the alloy being placed for 151 minutes, vacuum pumping and heating at the same time, performing the vacuum pumping at 500° C. for 2 hours, then being cooled, and the powder treated after hydrogen decrepitation process being taken out.

Fine crushing process: performing jet milling to the powder after hydrogen decrepitation in the crushing room under a pressure of 0.43 MPa and in the atmosphere of below 100 ppm of oxidizing gas, then obtaining fine powder with an average particle size of 4.26 μm. The oxidizing gas means oxygen or water.

Screening partial fine powder which is treated after the fine crushing process (occupies 30% of the total fine powder by weight), removing the powder with a particle size of smaller than 1.0 μm, then mixing the screened fine powder and the remaining unscreened fine powder. The powder which has a particle size smaller than 1.0 μm is reduced to less than 10% of total powder by volume in the mixed fine powder.

Methyl caprylate is added into the powder treated after jet milling, the additive amount is 0.23% of the mixed powder by weight, further the mixture is comprehensively mixed by a V-type mixer.

Compacting process under a magnetic field: a vertical orientation magnetic field molder being used, compacting the powder added with methyl caprylate in once to form a cube with sides of 25 mm in an orientation field of 1.8 T and under a compacting pressure of 0.2 ton/cm$^2$, then demagnetizing the once-forming cube in a 0.2 T magnetic field.

The once-forming compact is sealed so as not to expose to air, the compact is secondly compacted by a secondary compact machine (isostatic pressing compacting machine) under a pressure of 1.4 ton/cm$^2$.

Sintering process: moving each of the compact to the sintering furnace, firstly sintering in a vacuum of $10^{-3}$ Pa and maintained for 2 hours at 200° C. and for 2 hours at 900° C., respectively then sintering for 2 hours at 1020° C., after that filling Ar gas into the sintering furnace so that the Ar pressure would reach 0.1 MPa, then being cooled to room temperature.

Heat treatment process: annealing the sintered magnet for 1 hour at 620° C. in the atmosphere of high purity Ar gas, then being cooled to room temperature and taken out.

Machining process: machining the sintered magnet after heat treatment as a magnet with ϕ15 mm diameter and 5 mm thickness, the 5 mm direction being the orientation direction of the magnetic field.

Magnetic property evaluation process: testing the sintered magnet by NIM-10000H type nondestructive testing system for BH large rare earth permanent magnet from National Institute of Metrology.

Thermal demagnetization evaluation process: firstly testing the magnetic flux of the sintered magnet, heating the sintered magnet in the air at 100° C. for 1 hour, secondly testing the magnetic flux after being cooled; wherein the sintered magnet with a magnetic flux retention rate of above 95% is determined as a qualified product.

The magnetic property of the magnets manufactured by the sintered body in accordance with embodiments 1~6 are directly tested without grain boundary diffusion treatment. The evaluation results of the magnets of the embodiments and the comparing samples are shown in TABLE 12.

TABLE 12

| magnetic property evaluation of the embodiments and the comparing samples | | | | | | |
|---|---|---|---|---|---|---|
| NO. | Br (KGs) | $H_{cj}$ (KOe) | SQ (%) | $(BH)_{max}$ (MGOe) | BHH | Retention rate of the magnetic flux (%) |
| Embodiment 1 | 14.43 | 14.87 | 99.3 | 48.69 | 63.56 | 95.4 |
| Embodiment 2 | 14.41 | 16.15 | 99.5 | 48.58 | 64.73 | 97.4 |
| Embodiment 3 | 13.58 | 19.98 | 99.5 | 43.15 | 63.13 | 99.2 |
| Embodiment 4 | 13.68 | 18.99 | 99.3 | 44.26 | 63.25 | 98.3 |
| Embodiment 5 | 13.72 | 18.58 | 99.5 | 44.42 | 63.00 | 98.0 |
| Embodiment 6 | 13.71 | 22.56 | 99.2 | 44.01 | 66.57 | 99.5 |

In the manufacturing process, special attention is paid to the control of the contents of O, C and N, and the contents of the three elements O, C, and N are controlled below 0.5 at %, 0.3 at % and 0.2 at %, respectively.

In conclusion, when the content of Dy, Ho, Gd or Tb of the raw material is less than 1 at %, a high-property magnet with maximum energy product over 43 MGOe may be obtained.

Similarly, testing embodiments 1~6 with FE-EPMA, the content of the high-Cu crystal phase and the moderate Cu content crystal phase is over 65 volume % of the grain boundary composition by calculation.

Embodiment VII

Raw material preparing process: preparing Nd with 99.5% purity, industrial Fe—B, industrial pure Fe, Co with 99.9% purity, and Cu, Al and Si respectively with 99.5% purity; being counted in atomic percent at %.

The contents of each element are shown in TABLE 13:

TABLE 13

| | proportioning of each element | | | | | | |
|---|---|---|---|---|---|---|---|
| Composition | Nd | Co | B | Cu | Al | Si | Fe |
| Comparing sample 1 | 13.8 | 0.5 | 5.5 | 0.2 | 0.3 | 0.5 | remainder |
| Embodiment 1 | 13.8 | 0.5 | 5.5 | 0.3 | 0.3 | 0.5 | remainder |
| Embodiment 2 | 13.8 | 0.5 | 5.5 | 0.4 | 0.3 | 0.5 | remainder |
| Embodiment 3 | 13.8 | 0.5 | 5.5 | 0.6 | 0.3 | 0.5 | remainder |
| Embodiment 4 | 13.8 | 0.5 | 5.5 | 0.8 | 0.3 | 0.5 | remainder |
| Comparing sample 2 | 13.8 | 0.5 | 5.5 | 1 | 0.3 | 0.5 | remainder |
| Comparing sample 3 | 13.8 | 0.5 | 5.5 | 1.2 | 0.3 | 0.5 | remainder |

Preparing 100 Kg raw material of each sequence number group by weighing, respectively in accordance with TABLE 13.

Melting process: placing the prepared raw material into an aluminum oxide made crucible at a time, performing a vacuum melting in an intermediate frequency vacuum induction melting furnace in $10^{-2}$ Pa vacuum and below 1500° C.

Casting process: after the process of vacuum melting, filling Ar gas into the melting furnace so that the Ar pressure would reach 50000 Pa, then obtaining a quenching alloy by being casted with single roller quenching method at a quenching speed of $10^{2}$° C./s~$10^{4}$° C./s, thermal preservation treating the quenching alloy at 600° C. for 60 minutes, and then being cooled to room temperature.

Hydrogen decrepitation process: at room temperature, vacuum pumping the hydrogen decrepitation furnace placed with the quenching alloy, then filling hydrogen with 99.5% purity into the furnace until the pressure reach 0.1 MPa, after the alloy being placed for 139 minutes, vacuum pumping and heating at the same time, performing the vacuum pumping at 500° C. for 2 hours, then being cooled, and the powder treated after hydrogen decrepitation process being taken out.

Fine crushing process: performing jet milling to the powder after hydrogen decrepitation in the crushing room under a pressure of 0.42 MPa and in the atmosphere of oxidizing gas below 100 ppm, then obtaining fine powder with an average particle size of 4.32 μm of fine powder. The oxidizing gas means oxygen or water.

Screening partial fine powder which is treated after the fine crushing process (occupies 30% of the total fine powder by weight), removing the powder with a particle size of smaller than 1.0 μm, then mixing the screened fine powder and the remaining unscreened fine powder. The powder which has a particle size smaller than 1.0 μm is reduced to less than 10% of total powder by volume in the mixed fine powder.

Methyl caprylate is added into the powder treated after jet milling, the additive amount is 0.22% of the mixed powder by weight, further the mixture is comprehensively mixed by a V-type mixer.

Compacting process under a magnetic field: a vertical orientation magnetic field molder being used, compacting the powder added with methyl caprylate in once to form a cube with sides of 25 mm in an orientation field of 1.8 T and under a compacting pressure of 0.2 ton/cm$^2$, then demagnetizing the once-forming cube in a 0.2 T magnetic field.

The once-forming compact is sealed so as not to expose to air, the compact is secondly compacted by a secondary compact machine (isostatic pressing compacting machine) under a pressure of 1.4 ton/cm$^2$.

Sintering process: moving each of the compact to the sintering furnace, firstly sintering in a vacuum of $10^{-3}$ Pa and maintained for 2 hours at 200° C. and for 2 hours at 900° C., respectively then sintering for 2 hours at 1020° C., after that filling Ar gas into the sintering furnace until the Ar pressure would reach 0.1 MPa, then being cooled to room temperature.

Heat treatment process: annealing the sintered magnet for 1 hour at 620° C. in the atmosphere of high purity Ar gas, then being cooled to room temperature and taken out.

Machining process: machining the sintered magnet after heat treatment as a magnet with ϕ15 mm diameter and 5 mm thickness, the 5 mm direction being the orientation direction of the magnetic field.

Cleaning the magnet manufactured by the sintered body of the comparing samples 1~3 and embodiments 1~3, coating $DyF_3$ powder with a thickness of 5 μm on the surface of the magnet in a vacuum heat treatment furnace after the surface cleaning, treating the coated magnet after vacuum drying in Ar atmosphere at 850° C. for 24 hours, finally performing Dy grain boundary diffusion treatment. Adjusting the amount of evaporated Dy metal atom supplied to the surface of the sintered magnet, so that the attached metal atom is diffused into the grain boundary of the sintered magnet before formed as a thin film with the metal evaporation material on the surface of the sintered magnet.

Aging treatment: Aging treating the magnet with Dy diffusion treatment in vacuum at 500° C. for 2 hours, testing the magnetic property of the magnet after surface grinding.

Magnetic property evaluation process: testing the sintered magnet with Dy diffusion treatment by NIM-10000H type nondestructive testing system for BH large rare earth permanent magnet from National Institute of Metrology.

Thermal demagnetization evaluation process: firstly testing the magnetic flux of the sintered magnet with Dy diffusion treatment, heating the sintered magnet in the air at 100° C. for 1 hour, secondly testing the magnetic flux after being cooled; wherein the sintered magnet with a magnetic flux retention rate of above 95% is determined as a qualified product.

The evaluation results of the magnets of the embodiments and the comparing samples are shown in TABLE 14.

TABLE 14 magnetic property evaluation of the embodiments and the comparing samples

| NO. | Br (KGs) | $H_{cj}$ (KOe) | SQ (%) | $(BH)_{max}$ (MGOe) | BHH | Addition of coercivity after diffusion (KOe) | Retention rate of the magnetic flux (%) |
|---|---|---|---|---|---|---|---|
| Comparing sample 1 | 14.53 | 18.96 | 78.5 | 49.43 | 68.39 | 5.95 | 96.4 |
| Embodiment 1 | 14.50 | 23.94 | 99.1 | 49.3 | 73.24 | 10.26 | 99.4 |
| Embodiment 2 | 14.51 | 24.31 | 99.4 | 49.37 | 73.68 | 10.07 | 99.0 |
| Embodiment 3 | 14.47 | 24.95 | 99.5 | 48.92 | 73.87 | 10.28 | 99.3 |
| Embodiment 4 | 14.41 | 24.99 | 99.3 | 48.69 | 73.68 | 10.00 | 99.5 |
| Comparing sample 2 | 14.39 | 19.86 | 94.9 | 48.32 | 68.18 | 6.54 | 97.8 |
| Comparing sample 3 | 14.31 | 19.54 | 87.3 | 47.93 | 67.47 | 6.20 | 97.5 |

In the manufacturing process, special attention is paid to the control of the contents of O, C and N, and the contents of the three elements O, C, and N are controlled below 0.4 at %, 0.3 at % and 0.2 at %, respectively.

In conclusion, comparing the magnet with grain boundary diffusion with the magnet without grain boundary diffusion, the coercivity is increased with more than 10 (KOe), and the magnet with grain boundary diffusion has a very high coercivity and a favorable squareness.

In the composition of the present invention, reducing the melting point of intermetallic compound phase comprising high melting point (950° C.) $RCo_2$ phase by adding minor amounts of Cu, Co and other impurities, as a result, all of the crystal grain boundary are melted at the grain boundary diffusion temperature, the efficiency of the grain boundary diffusion is extraordinarily excellent, and the coercivity is improved to an unparalleled extent, moreover, as the squareness reaches over 99%, a high-property magnet with a favorable heat-resistance property may be obtained.

Similarly, testing embodiments 1~4 with FE-EPMA, the content of the high-Cu crystal phase and the moderate Cu content crystal phase is over 65 volume % of the grain boundary composition by calculation.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

We claim:

1. A low-B rare earth magnet containing a main phase of $R_2T_{14}B$ and comprising the following raw material components:

13.5 at %~14.5 at % of R, 5.2 at %~5.8 at % of B, 0.3 at %~0.8 at % of Cu, 0.3 at %~3 at % of Co, and a balance being T and inevitable impurities, wherein:

the R is at least one rare earth element comprising Nd, and the T is an element mainly comprising Fe the T further comprises X, the X is at least three elements selected from Al, Si, Ga, Sn, Ge, Ag, Au, Bi, Mn, Cr, P or S, and a total composition of the X is 0 at %-1.0 at %.

2. The low-B rare earth magnet according to claim 1, wherein:

and in the inevitable impurities, an amount of O is below 1 at %, an amount of C is below 1 at % and an amount of N is below 0.5 at %.

3. The low-B rare earth magnet according to claim 1, wherein the low-B rare earth magnet is manufactured by the following processes:

a process of preparing an alloy for rare earth magnet with molten rare earth magnet components;

processes of producing a fine powder by coarsely crushing and finely crushing the alloy for rare earth magnet; and processes of obtaining a compact by a magnetic field compacting method, sintering the compact in a vacuum or inert gas at a temperature of 900° C.~1100° C., and forming a first Cu crystal phase, a second Cu crystal phase and a third Cu crystal phase in a grain boundary of the low-B rare earth magnet, wherein:

a molecular composition of the first Cu crystal phase is a phase of $RT_2$ series, a molecular composition of the second Cu crystal phase is a phase of $R_6T_{13}X$ series, a molecular composition of the third Cu crystal phase is a phase of $RT_5$ series, and a total content of the first Cu crystal phase and the second Cu crystal phase is over 65 volume % of the grain boundary.

4. The low-B rare earth magnet according to claim 3, wherein the low-B rare earth magnet is a magnet of Nd—Fe—B series with a maximum magnetic energy product over 43 MGOe.

5. The low-B rare earth magnet according to claim 1, wherein:

the total composition of the X is 0.3 at %~1.0 at %.

6. The low-B rare earth magnet according to claim 5, wherein an amount of Dy, Ho, Gd or Tb is below 1 at % of the R.

7. The low-B rare earth magnet according to claim 5, wherein:

the X comprises Ga, and an amount of Ga is 0.1 at %~0.2 at %.

8. The low-B rare earth magnet according to claim 5, wherein oxygen content of the low-B rare earth magnet is below 0.6 at %.

9. A low-B rare earth magnet containing a main phase of $R_2T_{14}B$ and comprising the following raw material components:

13.5 at %~14.5 at % of R, 5.2 at %~5.8 at % of B, 0.3 at %~0.8 at % of Cu, 0.3 at %~3 at % of Co, and a balance being T and inevitable impurities, wherein:

the R is at least one rare earth element comprising Nd, the T is an element mainly comprising Fe the T further comprises X, the X is at least three elements selected from Al, Si, Ga, Sn, Ge, Ag, Au, Bi, Mn, Cr, P or S, and a total composition of the X is 0 at %-1.0 at %, and the low-B rare earth magnet is manufactured by the following processes:

a process of preparing an alloy for rare earth magnet with molten rare earth magnet components;

processes of producing a fine powder by coarsely crushing and finely crushing the alloy for rare earth magnet; and processes of obtaining a compact by a magnetic field compacting method, sintering the compact in a vacuum or inert gas at a temperature of 900° C.~1100° C., forming a first Cu crystal phase, a second Cu crystal phase and a third Cu crystal phase in a grain boundary of the low-B rare earth magnet, and performing RH grain boundary diffusion at a temperature of 700° C.~1050° C., wherein:

a molecular composition of the first Cu crystal phase is a phase of $RT_2$ series, a molecular composition of the second Cu crystal phase is a phase of $R_6T_{13}X$ series, a molecular composition of the third Cu crystal phase is a phase of $RT_5$ series, and a total content of the first Cu crystal phase and the second Cu crystal phase is over 65 volume % of the grain boundary.

10. The low-B rare earth magnet according to claim 9, wherein:

the RH is selected from Dy, Ho or Tb, and in the inevitable impurities, an amount of O is controlled below 1 at %, an amount of C is controlled below 1 at % and an amount of N is controlled below 0.5 at %.

11. The low-B rare earth magnet according to claim 9, wherein the low-B rare earth magnet is further manufactured using an aging treatment comprising treating the magnet after the RH grain boundary diffusion at a temperature of 400° C.~650° C.

12. The low-B rare earth magnet according to claim 10, wherein the low-B rare earth magnet is further manufactured using an aging treatment comprising treating the magnet after the RH grain boundary diffusion at a temperature of 400° C.~650° C.

* * * * *